US008204419B2

(12) United States Patent
Urano

(10) Patent No.: US 8,204,419 B2
(45) Date of Patent: Jun. 19, 2012

(54) FIXING DEVICE CONTAINING EXTENDED SOAKING MEMBER AND IMAGE FORMING APPARATUS CONTAINING FIXING APPARATUS

(75) Inventor: Etsuaki Urano, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 408 days.

(21) Appl. No.: 12/543,844

(22) Filed: Aug. 19, 2009

(65) Prior Publication Data

US 2010/0054828 A1 Mar. 4, 2010

(30) Foreign Application Priority Data

Sep. 1, 2008 (JP) ..... 2008-223149

(51) Int. Cl.
*G03G 15/20* (2006.01)

(52) U.S. Cl. ..... 399/328; 399/334

(58) Field of Classification Search ..... 399/328, 399/333, 334; 219/216
See application file for complete search history.

(56) References Cited

U.S. PATENT DOCUMENTS

| | | | | |
|---|---|---|---|---|
| 4,977,431 | A | 12/1990 | Fuji | |
| 5,403,995 | A | 4/1995 | Kishino et al. | |
| 5,426,495 | A | 6/1995 | Sawamura et al. | |
| 6,132,815 | A | 10/2000 | Takahashi et al. | |
| 6,183,869 | B1 | 2/2001 | Okuda et al. | |
| 6,445,902 | B1 | 9/2002 | Hirst et al. | |
| 6,477,350 | B1 | 11/2002 | Nishimura | |
| 6,847,798 | B2 | 1/2005 | Cho et al. | |
| 6,911,240 | B2 | 6/2005 | Kondoh | |
| 7,257,361 | B2 | 8/2007 | Takagi et al. | |
| 7,349,660 | B2 | 3/2008 | Domoto et al. | |
| 7,466,950 | B2 * | 12/2008 | Matsuura et al. | 399/328 |
| 7,747,195 | B2 * | 6/2010 | Yoshino et al. | 399/328 |
| 7,917,075 | B2 * | 3/2011 | Sone et al. | 399/334 |
| 7,925,198 | B2 * | 4/2011 | Urano | 399/333 |
| 8,050,612 | B2 * | 11/2011 | Kinouchi et al. | 399/333 |
| 2004/0069404 | A1 | 4/2004 | Kondoh | |
| 2004/0265021 | A1 | 12/2004 | Kinouchi et al. | |
| 2005/0269065 | A1 | 12/2005 | Chen | |
| 2006/0014021 | A1 | 1/2006 | Sugawara et al. | |

(Continued)

FOREIGN PATENT DOCUMENTS

| | | |
|---|---|---|
| JP | 53-106136 | 9/1978 |

(Continued)

OTHER PUBLICATIONS

Office Action (Preliminary Notice of Rejection) dated Jun. 15, 2010, issued in the corresponding Japanese Patent Application No. 2008-223149, and an English Translation thereof.

(Continued)

*Primary Examiner* — William J Royer
(74) *Attorney, Agent, or Firm* — Buchanan Ingersoll & Rooney PC

(57) ABSTRACT

A portion 421 on each inner surface of both end sections 42*c*, 42*d* of an exciting coil 42, which is positioned on an outermost side in a width direction of a fixing roller 1, is positioned within an edge of a maximum paper feed area Z in the width direction of the fixing roller 1. A heat pipe 3 extends to farther outside of the maximum paper feed area Z in the width direction of the fixing roller 1.

6 Claims, 10 Drawing Sheets

U.S. PATENT DOCUMENTS

| | | | |
|---|---|---|---|
| 2006/0140689 | A1 | 6/2006 | Echigo et al. |
| 2007/0003335 | A1 | 1/2007 | de Jong et al. |
| 2007/0074395 | A1 | 4/2007 | Hou et al. |
| 2008/0124151 | A1 | 5/2008 | Kagawa |
| 2009/0314478 | A1 | 12/2009 | Yamada et al. |
| 2009/0317152 | A1 | 12/2009 | Urano |

FOREIGN PATENT DOCUMENTS

| | | | |
|---|---|---|---|
| JP | 56-027886 | | 3/1981 |
| JP | 03-164775 | | 7/1991 |
| JP | 7-028351 | | 1/1995 |
| JP | 07-036303 | | 2/1995 |
| JP | 07-064420 | | 3/1995 |
| JP | 08-248797 | | 9/1996 |
| JP | 09-179427 | | 7/1997 |
| JP | 10-291045 | | 11/1998 |
| JP | 2000-162912 | A | 6/2000 |
| JP | 2000-162913 | A | 6/2000 |
| JP | 2001-135470 | A | 5/2001 |
| JP | 2001-230065 | | 8/2001 |
| JP | 2002-055552 | | 2/2002 |
| JP | 2002-062752 | | 2/2002 |
| JP | 2002-082569 | | 3/2002 |
| JP | 2002-328559 | | 11/2002 |
| JP | 2003-098877 | | 4/2003 |
| JP | 2003-131504 | | 5/2003 |
| JP | 2005-037859 | | 2/2005 |
| JP | 2005-049455 | | 2/2005 |
| JP | 2005-049812 | | 2/2005 |
| JP | 2005-305809 | | 11/2005 |
| JP | 2006-200775 | | 8/2006 |
| JP | 2007-079238 | | 3/2007 |
| JP | 2007-108212 | | 4/2007 |
| JP | 2007-108213 | | 4/2007 |
| JP | 2008-102403 | | 5/2008 |
| WO | WO 00/05629 | | 2/2000 |

OTHER PUBLICATIONS

Partial European Search Report dated Sep. 6, 2010, issued in the corresponding European Application No. 09007925.2-2209.

European Search Report dated Nov. 24, 2010, issued in the corresponding European Application No. 09007925.2-2209.

Office Action (Preliminary Notice of Rejection) dated Feb. 8, 2011, issued in the corresponding Japanese Patent Application No. 2008-318328, and an English Translation thereof.

Office Action (Decision on Appeal) dated Apr. 5, 2011, issued in the corresponding Japanese Patent Application No. 2008-223149, and an English Translation thereof.

First Office Action dated Apr. 26, 2011, issued in the corresponding Chinese Patent Application No. 200910166830.0, and an English Translation thereof.

Search Report dated May 2, 2011, issued in the corresponding European Application No. 09010878.8-2209.

Office Action (Notice of Final Rejection) dated Oct. 26, 2010, issued in the corresponding Japanese Patent Application No. 2008-223149, and an English Translation thereof.

Office Action (Preliminary Notice of Rejection) dated Jun. 29, 2010, issued in Japanese Patent Application No. 2008-159286, and an English Translation thereof.

Office Action (Preliminary Notice of Rejection) dated Jul. 6, 2010, issued in Japanese Patent Application No. 2008-239538, and an English Translation thereof.

Office Action (Preliminary Notice of Rejection) dated Sep. 14, 2010, issued in Japanese Patent Application No. 2008-159286, and an English Translation thereof.

Office Action (Decision to Grant Patent) dated May 17, 2011, issued in Japanese Patent Application No. 2008-159286, and an English Translation thereof.

* cited by examiner

*Fig.10A*

| POSITION (mm) | 0 | 105 | 120 | 155 | 170 |
|---|---|---|---|---|---|
| WORKING EXAMPLE 1 (°C) | 172.3 | 171.6 | 170.4 | 157.3 | 140.5 |
| WORKING EXAMPLE 2 (°C) | 173.4 | 173.1 | 172.3 | 168.2 | 167.5 |
| WORKING EXAMPLE 3 (°C) | 172.5 | 172.1 | 173.3 | 175.2 | 173.6 |
| WORKING EXAMPLE 4 (°C) | 172.6 | 171.5 | 171.3 | 155.6 | 141.5 |
| WORKING EXAMPLE 5 (°C) | 173.5 | 173.2 | 172.3 | 170.1 | 168.3 |
| WORKING EXAMPLE 6 (°C) | 172.1 | 172.4 | 173.2 | 175.4 | 173.5 |
| COMPARATIVE EXAMPLE 1 (°C) | 174.6 | 180.3 | 186.2 | 225.5 | 232.7 |
| COMPARATIVE EXAMPLE 2 (°C) | 175.1 | 179.4 | 188.1 | 228.5 | 246.6 |
| COMPARATIVE EXAMPLE 3 (°C) | 174.6 | 180.2 | 186.2 | 205.6 | 212.9 |
| COMPARATIVE EXAMPLE 4 (°C) | 174.5 | 176.7 | 184.1 | 221.7 | 231.5 |

*Fig.10B*

| POSITION (mm) | 0 | 105 | 120 | 155 | 170 |
|---|---|---|---|---|---|
| WORKING EXAMPLE 1 (°C) | 173.5 | 173.4 | 174.3 | 178.6 | 179.1 |
| WORKING EXAMPLE 2 (°C) | 172.2 | 172.6 | 173.3 | 184.1 | 193.8 |
| WORKING EXAMPLE 3 (°C) | 172.3 | 173.1 | 185.5 | 218.4 | 224.6 |
| WORKING EXAMPLE 4 (°C) | 173.1 | 173.2 | 174.1 | 177.2 | 177.7 |
| WORKING EXAMPLE 5 (°C) | 172.5 | 172.2 | 181.3 | 184.7 | 192.1 |
| WORKING EXAMPLE 6 (°C) | 172.2 | 173.5 | 185.3 | 191.0 | 206.6 |
| COMPARATIVE EXAMPLE 1 (°C) | 174.5 | 177.2 | 188.6 | 240.3 | 245.5 |
| COMPARATIVE EXAMPLE 2 (°C) | 177.3 | 185.6 | 203.2 | 246.1 | 251.8 |
| COMPARATIVE EXAMPLE 3 (°C) | 173.6 | 175.5 | 187.1 | 218.5 | 229.3 |
| COMPARATIVE EXAMPLE 4 (°C) | 175.1 | 184.3 | 195.8 | 224.3 | 243.5 |

FIXING DEVICE CONTAINING EXTENDED SOAKING MEMBER AND IMAGE FORMING APPARATUS CONTAINING FIXING APPARATUS

CROSS-REFERENCE TO RELATED APPLICATION

This application is based on application No. 2008-223149 filed in Japan, the entire content of which is hereby incorporated by reference.

TECHNICAL FIELD

The present invention relates to a fixing device for use in image forming apparatuses such as copying machines, printers and facsimiles, and to an image forming apparatus having the fixing device.

BACKGROUND ART

Conventional fixing devices include one having a fixing roller, a pressure roller, and an electromagnetic induction heating section (see JP 2001-135470 A). The electromagnetic induction heating section performs induction heating of the fixing roller. The fixing roller and the pressure roller fix images on paper sheets through application of heat and pressure.

The electromagnetic induction heating section has an annular exciting coil and a degaussing coil which cancels magnetic flux of the exciting coil. The inside diameter of the annular exciting coil is larger than a paper feed area for large-size paper sheets.

However, in the conventional fixing device, the inside diameter of the annular exciting coil was larger than the paper feed area for the large-size paper sheets, which caused a problem that a non-paper feed area on the fixing roller for the large-size paper sheets was heated. Moreover, since the exciting coil was large, it was impossible to achieve downsizing and cost reduction of the electromagnetic induction heating section.

Further, the presence of the degaussing coil brought about further upsizing of the electromagnetic induction heating section and thereby caused a problem of cost increase in the electromagnetic induction heating section.

SUMMARY OF THE INVENTION

Accordingly, an object of the present invention is to provide a fixing device and an image forming apparatus which can suppress temperature rise in a non-paper feed area while implementing downsizing and cost reduction of an electromagnetic induction heating section.

In order to accomplish the above object, a fixing device of the invention comprises:

a fixing-side rotating member and a pressure-side rotating member which come into contact with each other to convey a recording material while fixing toner on the recording material;

an electromagnetic induction heating section for performing induction heating of the fixing-side rotating member; and a soaking member which comes into contact with at least one of the fixing-side rotating member and the pressure-side rotating member, wherein the electromagnetic induction heating section has an annular exciting coil extending in a width direction of the fixing-side rotating member, the exciting coil has both end sections in the width direction of the fixing-side rotating member, a portion on each inner surface of both the end sections, which is positioned on an outermost side in the width direction, is identical with an edge of a passing area of a maximum-size recording material which passes through between the fixing-side rotating member and the pressure-side rotating member, or is positioned within the edge of the passing area in the width direction, and the soaking member extends to farther outside of the passing area of the maximum-size recording material in the width direction.

According to the fixing device of the invention, the portion on the inner surface of both the end sections of the exciting coil, which is positioned on the outermost side, is identical with the edge of the passing area of the maximum-size recording material, or is positioned within the edge of the passing area in the width direction. Therefore, it becomes possible to shorten the exciting coil so as to suppress heating of a non-passing area of the fixing-side rotating member where the maximum-size recording material does not pass. Moreover, the soaking member extends to farther outside of the passing area of the maximum-size recording material in the width direction, and therefore even when the recording materials are continuously passed and thereby the temperature in the non-passing area of the fixing-side rotating member rises, it becomes possible to transfer heat from the non-passing area to the passing area via the soaking member.

Thus, even when the recording materials, regardless of their sizes, are continuously passed, it becomes possible to suppress the temperature rise in the non-passing area and to spare additional degaussing coils provided for passing of small-size recording materials, so that the degaussing coils can be omitted.

Therefore, it becomes possible to suppress the temperature rise in the non-passing area and to prevent heat deterioration of the fixing-side rotating member and the pressure-side rotating member, while implementing downsizing and cost reduction of the electromagnetic induction heating section by reducing the number of degaussing coils and shortening the exciting coil.

In a fixing device of one embodiment, the electromagnetic induction heating section has degaussing coils which cancel magnetic flux generated by the exciting coil, and the degaussing coils are placed so as to be superimposed on both the end sections of the exciting coil.

According to the fixing device in the embodiment, the degaussing coils of the electromagnetic induction heating section are placed so as to be superimposed on both the end sections of the exciting coil, so that heating of the non-passing area of the recording material on the fixing-side rotating member can reliably be suppressed.

In a fixing device of one embodiment, the degaussing coils extend farther outside of the exciting coil in the width direction.

According to the fixing device in this embodiment, the degaussing coils extend to farther outside of the exciting coil in the width direction, so that heating of the non-passing area of the recording material on the fixing-side rotating member can be suppressed more reliably.

In a fixing device of one embodiment, the soaking member comes into contact with the pressure-side rotating member, the soaking member is a heat pipe, and the pressure-side rotating member has a cored bar and at least a metal layer outside of the cored bar in a radial direction.

According to the fixing device in this embodiment, the pressure-side rotating member has the metal layer, so that the heat directly transmitted from the fixing-side rotating member to the pressure-side rotating member can be transported via the metal layer of the pressure-side rotating member, which makes it possible to equalize the temperature in the width direction of the pressure-side rotating member. Since the soaking member is the heat pipe which comes into contact with the pressure-side rotating member, it becomes possible to further equalize the temperature in the width direction of the pressure-side rotating member.

In a fixing device of one embodiment, the soaking member comes into contact with the fixing-side rotating member, the soaking member is a heat pipe, and the fixing-side rotating member has a cored bar and at least a metal electromagnetic induction exothermic layer outside of the cored bar in a radial direction.

According to the fixing device in this embodiment, the fixing-side rotating member has the metal electromagnetic induction exothermic layer, so that the heat in the fixing-side rotating member can be transported by the electromagnetic induction exothermic layer of the fixing-side rotating member so as to equalize the temperature in the width direction of the fixing-side rotating member. Since the soaking member is the heat pipe which comes into contact with the fixing-side rotating member, it becomes possible to further equalize the temperature in the width direction of the fixing-side rotating member.

The image forming apparatus of the invention has the fixing device.

Since the image forming apparatus of the invention has the fixing device, enhanced durability, downsizing and cost reduction can be achieved.

According to the fixing device of the invention, the portion on each inner surface of both the end sections of the exciting coil, which is positioned on the outermost side, is identical with the edge of the passing area of the maximum-size recording material, or is positioned within the edge of the passing area in the width direction, and the soaking member extends to farther outside of the passing area of the maximum-size recording material in the width direction. This makes it possible to suppress the temperature rise in the non-paper feed area while implementing downsizing and cost reduction of the electromagnetic induction heating section.

Since the image forming apparatus of the invention has the fixing device, enhanced durability, downsizing and cost reduction can be achieved.

BRIEF DESCRIPTION OF THE DRAWINGS

The present invention will become more fully understood from the detailed description given hereinbelow and the accompanying drawings which are given by way of illustration only, and thus are not intended to limit the present invention, and wherein:

FIG. 10A is a table showing the result of measurement for A3 paper fed in landscape direction; and FIG. 10B is a table showing the result of measurement for A4 paper fed in portrait direction.

DESCRIPTION OF EMBODIMENTS

Hereinbelow, the present invention will be described in details in conjunction with the embodiments with reference to the drawings.

First Embodiment

Figure 1:
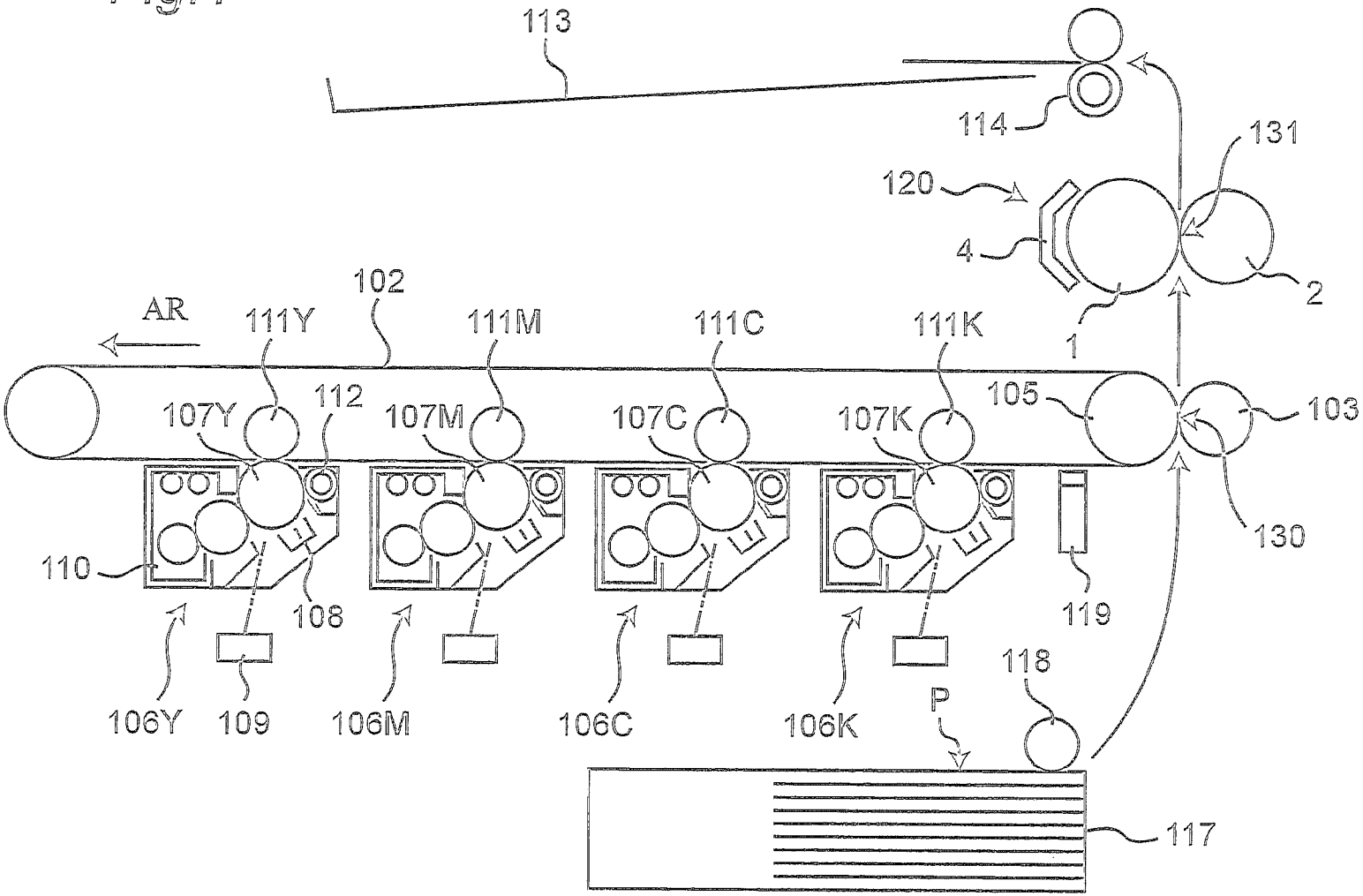
FIG. 1 is a simplified structure view showing an image forming apparatus in one embodiment of the invention.

FIG. 1 shows the simplified structure view of an image forming apparatus of the invention. The image forming apparatus, which is a color printer, has an intermediate transfer belt 102 as a belt member in generally the central section of the inside thereof. Under the lower horizontal section of the intermediate transfer belt 102, four imaging units 106Y, 106M, 106C and 106K respectively corresponding to colors of yellow (Y), magenta (M), cyan (C) and black (K) are juxtaposed along with the intermediate transfer belt 102. The imaging units 106Y, 106M, 106C and 106K have photoconductor drums 107Y, 107M, 107C and 107K, respectively.

A charger 108, a print head section 109, a developing device 110, each of primary transfer rollers 111Y, 111M, 111C and 111K, and a cleaner 112 are placed in this order around each of the photoconductor drums 107Y, 107M, 107C and 107K along the rotation direction thereof. Each of the primary transfer rollers 111Y, 111M, 111C and 111K faces each of the photoconductor drums 107Y, 107M, 107C and 107K across the intermediate transfer belt 102.

A portion of the intermediate transfer belt 102 supported with a driving roller 105 is put in pressure contact with a secondary transfer roller 103, and a nip section composed of the secondary transfer roller 103 and the intermediate transfer belt 102 forms a secondary transfer region 130.

In a conveying path downstream of the secondary transfer region 130, a fixing device 120 is placed, and the fixing device 120 has a fixing roller 1, a pressure roller 2 and an electromagnetic induction heating section 4. A pressure contact section between the fixing roller 1 and the pressure roller 2 serves as a fixing nip area 131.

A paper cassette 117 is detachably placed in the lower part of the image forming apparatus. A stack of paper sheets P stored in the paper cassette 117 are sent out one sheet at a time from the topmost sheet to the conveying path by rotation of a feed roller 118.

An AIDC (Auto Image Density Control) sensor 119 which also serves as a resist sensor is placed in between the imaging unit 106K on the most downstream side of the intermediate transfer belt 102 and the secondary transfer region 130.

Description is now given of the operation of the above-structured image forming apparatus.

Upon reception of an image signal inputted from an external unit (e.g., personal computer) into an image signal processing section (not shown) of the image forming apparatus, the image signal processing section converts the image signal into digital image signals of yellow (Y), magenta (M), cyan (C) and black (K). Based on the inputted digital signals, print head sections 109 of the respective imaging units 106Y, 106M, 106C and 106K are made to emit light for exposure.

Accordingly, electrostatic latent images formed on each of the photoconductor drums 107Y, 107M, 107C and 107K are developed by each developing device 110 into toner images of respective colors.

The toner images of respective colors are then superposed on top of each other and primarily transferred onto the intermediate transfer belt 102 which moves in an arrow AR direction due to the function of the primary transfer rollers 111Y, 111M, 111C and 111K.

Thus, the toner images formed on the intermediate transfer belt 102 reach the secondary transfer region 130 with the movement of the intermediate transfer belt 102. In the secondary transfer region 130, the superposed toner images of respective colors are secondarily transferred onto a paper sheet P in a batch with the function of the secondary transfer roller 103.

The toner images secondarily transferred onto the paper sheet P then reach the fixing nip area 131. In the fixing nip area 131, the toner images are fixed onto the paper sheet P by the function of the fixing roller 1 which is induction-heated by the electromagnetic induction heating section 4 and the pressure roller 2.

The paper sheet P with the toner images fixed thereon is then discharged into a paper ejection tray 113 via a paper ejecting roller 114.

Figure 2:
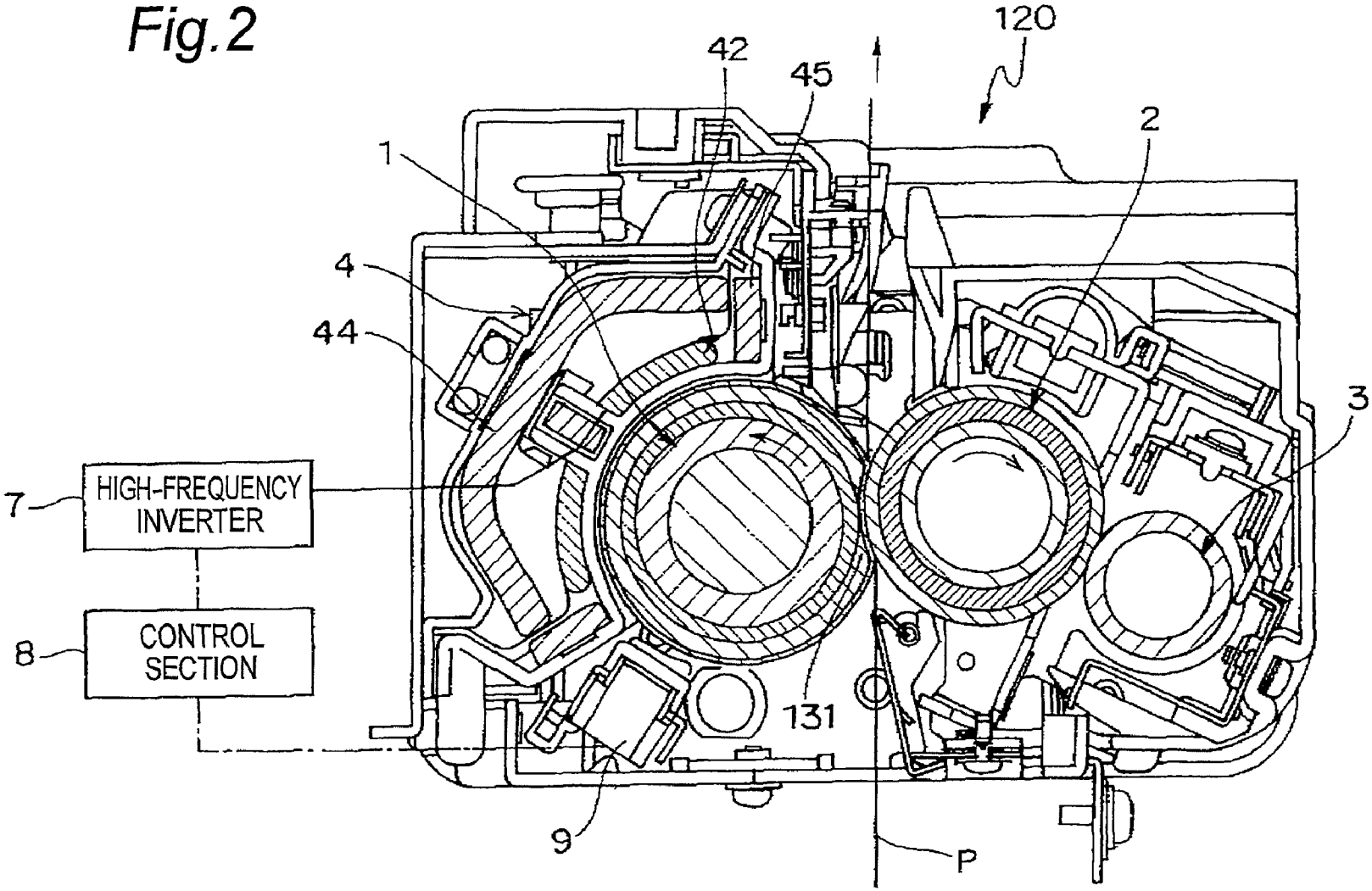
FIG. 2 is a simplified structure view showing a fixing device in one embodiment of the invention.

As shown in FIG. 2, the fixing device 120 is composed of the fixing roller 1 as a fixing-side rotating member, the pressure roller 2 as a pressure-side rotating member, the electromagnetic induction heating section 4, and a heat pipe 3 as a soaking member.

The fixing roller 1 and the pressure roller 2 come into contact with each other to convey the paper sheet P as a recording material while fixing the toner on the paper sheet P. The fixing roller 1 is heated by the electromagnetic induction heating section 4.

The heat pipe 3 comes into contact with the pressure roller 2 and assists heat transfer between the surfaces of the fixing roller 1 and the pressure roller 2 so as to equalize the surface temperature of the fixing roller 1 and the pressure roller 2.

The fixing roller 1, the pressure roller 2 and the heat pipe 3 are arranged in parallel with each other, and both the end sections of each roller are rotatably supported by unshown bearing members.

The pressure roller 2 is biased toward the fixing roller 1 by an unshown pressurizing mechanism such as springs, and forms the fixing nip area 131. The heat pipe 3 is also put in pressure contact with the pressure roller 2 in a similar manner.

The pressure roller 2 is rotated clockwise as shown with an arrow at a predetermined circumferential speed by an unshown drive mechanism. The fixing roller 1 rotates following after the rotation of the pressure roller 2 by frictional force due to pressure contact with the pressure roller 2 in the fixing nip area 131, and the heat pipe 3 also rotates similarly by frictional force due to pressure contact of the pressure roller 2.

The surface temperature of the fixing roller 1 is detected by a temperature sensor 9, and signals of the temperature sensor 9 are inputted into a control section 8. The temperature sensor 9 is, for example, a noncontact-type infrared sensor.

The control section 8 controls heating and temperature control of the fixing roller 1 based on the signal of the temperature sensor 9. More specifically, the control section 8 performs automatic control of high-frequency inverter 7 by increasing or decreasing electric power supply from the high-frequency inverter 7 to the electromagnetic induction heating section 4 based on the signal of the temperature sensor 9 so as to keep the surface temperature of the fixing roller 1 constant.

The electromagnetic induction heating section 4 has an annular exciting coil 42, and main core 44 and edge core 45. The exciting coil 42 is so structured that a lead wire is coiled along the width direction (axial direction) of the fixing roller 1. The exciting coil 42, which is connected to the high-frequency inverter 7 to receive high-frequency power of 10 to 100 kHz, 100 to 2000 W, is formed from a litz wire composed of tens to hundreds of bundled thin wires coated with heat-resistant resin.

The magnetic flux induced by the exciting coil 42 passes through the inside of the main core 44 and the edge core 45, travels through an electromagnetic induction exothermic layer of the fixing roller 1, and induces an eddy current in an electromagnetic induction exothermic layer to generate Joule heat.

Description is now given of a fixing operation. When the pressure roller 2 is rotated, the fixing roller 1 is rotated following after the rotation of the pressure roller 2, and the electromagnetic induction heating section 4 heats the fixing roller 1 so as to put the fixing roller 1 under automatic control to keep the surface temperature constant. In this state, a paper sheet P carrying an unfixed toner image is introduced into the fixing nip area 131 of the fixing roller 1 and the pressure roller 2. In this case, the face of the paper sheet P carrying the unfixed image faces the fixing roller 1.

The paper sheet P introduced into the fixing nip area 131 between the fixing roller 1 and the pressure roller 2 is conveyed in the state of being held in the fixing nip area 131 while being heated by the fixing roller 1, so that the unfixed toner image is melt and fixed onto the paper sheet P, and the paper sheet P is then discharged.

Figure 3:
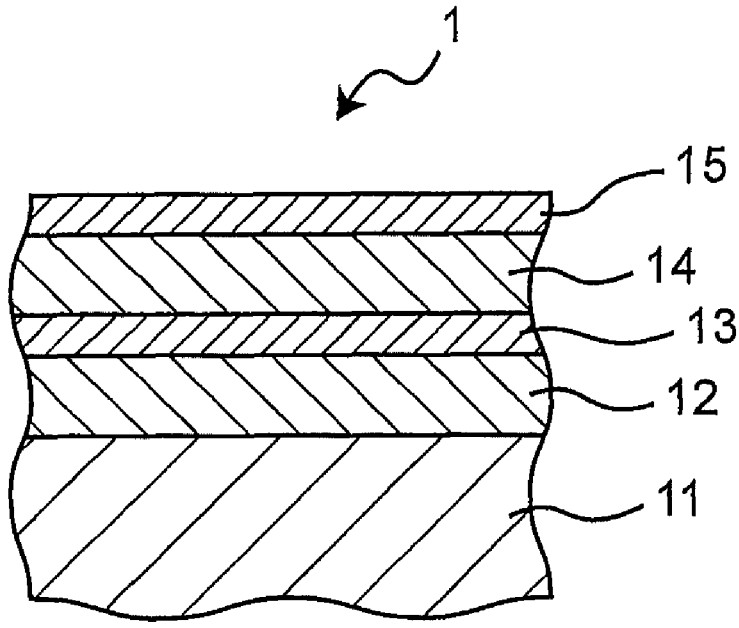
FIG. 3 is an expanded sectional view of a fixing roller.

As shown in FIG. 3, the fixing roller 1 has a cored bar 11, a heat insulating layer 12, an electromagnetic induction exothermic layer 13, an elastic layer 14, and a releasing layer 15 placed in this order from the inside to the outside.

The cored bar 11 is made of nonmagnetic stainless steel. The heat insulating layer 12 is made of silicone sponge rubber. The electromagnetic induction exothermic layer 13 is made of metal such as electroformed Ni, SUS, Fe-based alloy, aluminum-based alloy, and Cu alloy. The thickness of the electromagnetic induction exothermic layer 13 is 35 to 60 μm. The elastic layer 14 is made of silicone rubber having thermal conductivity of 0.5 W/m° C. or more and a thickness of 150 μm to 300 μm. The releasing layer 15 is made of a PFA resin tube having a thickness of 30 μm to 50 μm.

Figure 4:
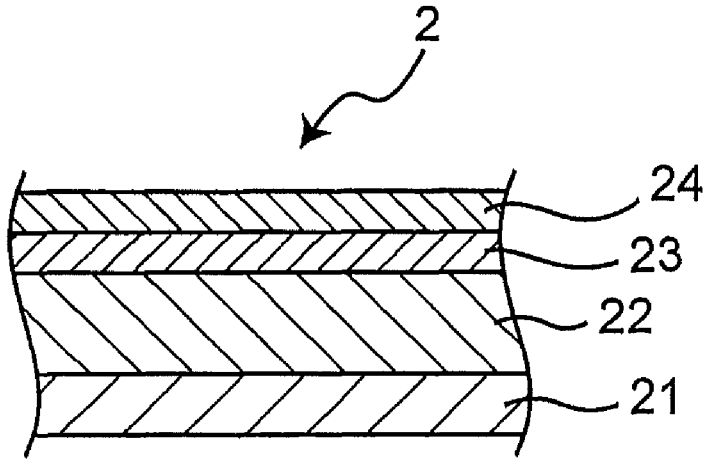
FIG. 4 is an expanded sectional view of a pressure roller.

As shown in FIG. 4, the pressure roller 2 has a cored bar 21, a low-thermal conductivity elastic layer 22, a metal layer 23, and a releasing layer 24 placed in this order from the inside to the outside.

The metal layer 23 is made of electroformed Ni, SUS, Fe-based alloy, aluminum-based alloy, or Cu alloy. The thickness of the metal layer 23 is 35 to 60 μm. The releasing layer 24 is made of PFA powder resin, PFA dispersion paint, PFA/PTFE mixture dispersion paint, or a PFA tube. The thickness of the releasing layer 24 is 20 to 50 μm. The releasing layer 24 prevents adhesion of toner contamination to the pressure roller 2, and enhances the image quality of the paper sheet P.

The elastic layer 22 is made of silicone rubber or silicone sponge having 0.3 W/m° C. or less. The thickness of the elastic layer 22 is 1 mm or more. The elastic layer 22 prevents leakage of heat from the metal layer 23 to the cored bar 21.

It is to be noted that a high-thermal conductivity elastic layer may be provided between the metal layer 23 and the releasing layer 24. The thermal conductivity of the high-thermal conductivity elastic layer is larger than the thermal conductivity of the low-thermal conductivity elastic layer 22. The high-thermal conductivity elastic layer is made of silicone rubber with 0.5 W/m° C. or more. The thickness of the high-thermal conductivity elastic layer is 150 to 300 μm.

Figure 5:
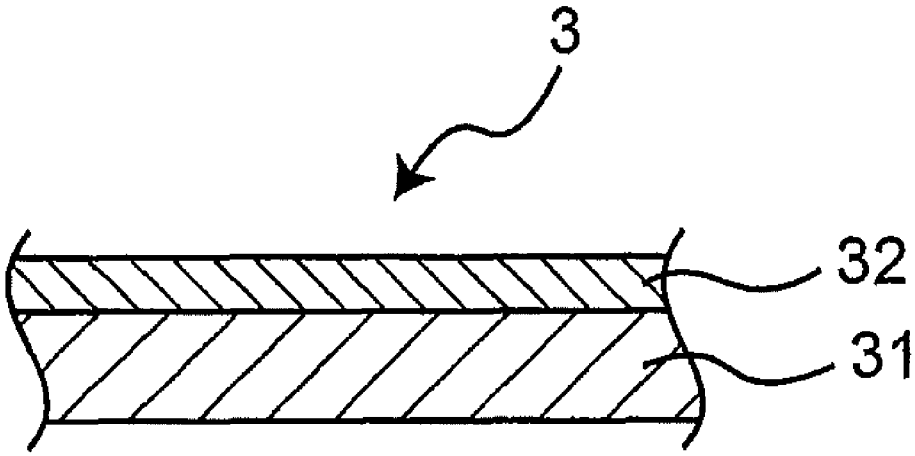
FIG. 5 is an expanded sectional view of a heat pipe.

As shown in FIG. 5, the heat pipe 3 has a tube section 31 and a releasing layer 32 which is outside of the tube section 31.

The tube section 31 is made of Fe alloy, SUS, or Al alloy. The tube section 31 has a thickness of 0.5 mm, an outer diameter of 21 mm and a length of 340 mm.

The releasing layer 32 is made of PFA powder resin, PFA dispersion paint, PFA/PTFE mixture dispersion paint, or a PFA tube. The thickness of the releasing layer 32 is 20 to 50 μm. The releasing layer 32 prevents adhesion of toner contamination to the heat pipe 3, and enhances the image quality of the paper sheet P.

The tube section 31 is filled with water as working fluid. Heat transfer is made through evaporation and condensation of the working fluid, by which the temperature of the pressure roller 2 in the width direction (axial direction) is equalized.

Figure 6:
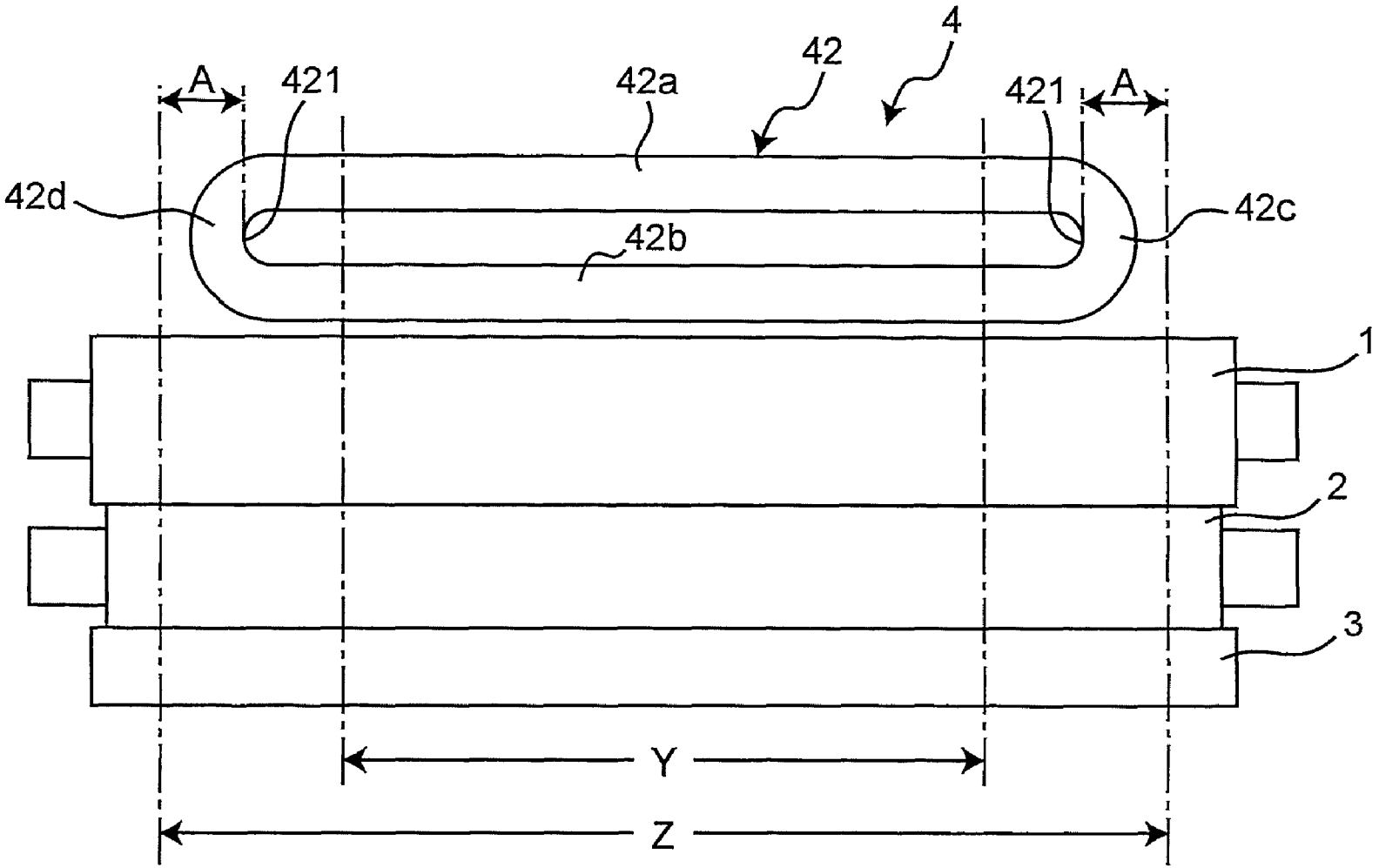
FIG. 6 is a development view of the fixing device.

As shown in FIG. 6, the exciting coil 42, which is formed into a ring-like oval shape in plan view, extends in the width direction of the fixing roller 1.

The exciting coil 42 has a pair of central sections 42*a*, 42*b* which extend in the width direction of the fixing roller 1, and a pair of end sections 42*c*, 42*d* positioned on both the ends in width direction of the fixing roller 1 for coupling a pair of the central sections 42*a*, 42*b*.

A pair of the central sections 42*a*, 42*b* is in a generally linear shape which is generally parallel to the axis of the fixing roller 1. A pair of the end sections 42*c*, 42*d* are in a generally circular shape. A clearance exists between a pair of the central sections 42*a* and 42*b*.

A portion on each inner surface of both the end sections 42*c*, 42*d*, which is positioned on the outermost side in the width direction of the fixing roller 1 (hereinafter referred to as an outermost portion 421), is positioned within the edge of a paper feed area (hereinafter referred to as a maximum paper feed area Z) of maximum-size paper sheets, which are fed between the fixing roller 1 and the pressure roller 2, in the width direction of the fixing roller 1. In short, a portion of the exciting coil 42 having the largest inside diameter (long diameter) in the width direction of the fixing roller 1 is smaller than the width of the maximum paper feed area Z.

The outermost portion 421 is positioned outside of a paper feed area Y of A4 portrait size paper in the width direction of the fixing roller 1. The width of the maximum paper feed area Z is, for example, 311 mm, which is the width of A3 paper fed in landscape direction. The width of the paper feed area Y of A4 portrait size paper is 210 mm.

It is to be noted that the outermost portion 421 may be identical with the edge of the maximum paper feed area Z. More specifically, a distance A between the outermost portion 421 and the edge of the maximum paper feed area Z should be zero or less when an area within the edge of the maximum paper feed area Z in the width direction of the fixing roller 1 is set as a negative area and an area outside the edge of the maximum paper feed area Z in the width direction of the fixing roller 1 is set as a positive area.

The heat pipe 3 extends to farther outside of the maximum paper feed area Z in the width direction of the fixing roller 1. In short, the length of the heat pipe 3 is larger than the width of the maximum paper feed area Z.

According to the above-structured fixing device, the outermost portion 421 of both the end sections 42*c*, 42*d* of the exciting coil 42 is identical with the edge of the maximum paper feed area Z, or positioned within the edge of the maximum paper feed area Z in the width direction of the fixing roller 1. Therefore, it becomes possible to shorten the exciting coil 42 so as to suppress heating of a non-paper feed area of the fixing roller 1 where the maximum-size paper sheets do not pass. Moreover, the heat pipe 3 extends to farther outside of the maximum paper feed area Z in the width direction, and therefore even when paper sheets are continuously fed and thereby the temperature of the non-paper feed area on the fixing roller 1 rises, heat can be transferred from the non-paper feed area to the paper feed area via the heat pipe 3.

Thus, even when the paper sheets, regardless of their sizes, are continuously fed, it becomes possible to suppress the temperature rise in the non-paper feed area and to spare additional degaussing coils provided for feeding of small-size paper sheets so that the degaussing coils can be omitted.

Therefore, it becomes possible to suppress the temperature rise in the non-paper feed area and to prevent heat deterioration of the fixing roller 1 and the pressure roller 2, while implementing downsizing and cost reduction of the electromagnetic induction heating section 4 by omitting the degaussing coils and shortening the exciting coil 42.

Since the exciting coil 42 is shortened, heat can be transferred from the central section of the maximum paper feed area Z to the vicinity of the edge of the maximum paper feed area Z via the heat pipe 3 even if the temperature decreases in the vicinity of the edge of the maximum paper feed area Z in the fixing roller 1, and therefore the fixability in the vicinity of the edge of the maximum paper feed area Z can be prevented from being degraded.

Since the pressure roller 2 has the metal layer 23, the heat directly transmitted from the fixing roller 1 to the pressure roller 2 can be transported through the metal layer 23 of the pressure roller 2, which makes it possible to equalize the temperature in the width direction of the pressure roller 2. Since the heat pipe 3 comes into contact with the pressure roller 2, heat is transferred between the metal layer 23 of the pressure roller 2 and the heat pipe 3, i.e., heat is transferred between metals. Therefore, particularly good thermal conductivity is obtained, which make it possible to further equalize the temperature in the width direction of the pressure roller 2.

Since the above-structured image forming apparatus has the fixing device, enhanced durability, downsizing and cost reduction can be achieved.

Second Embodiment

Figure 7:
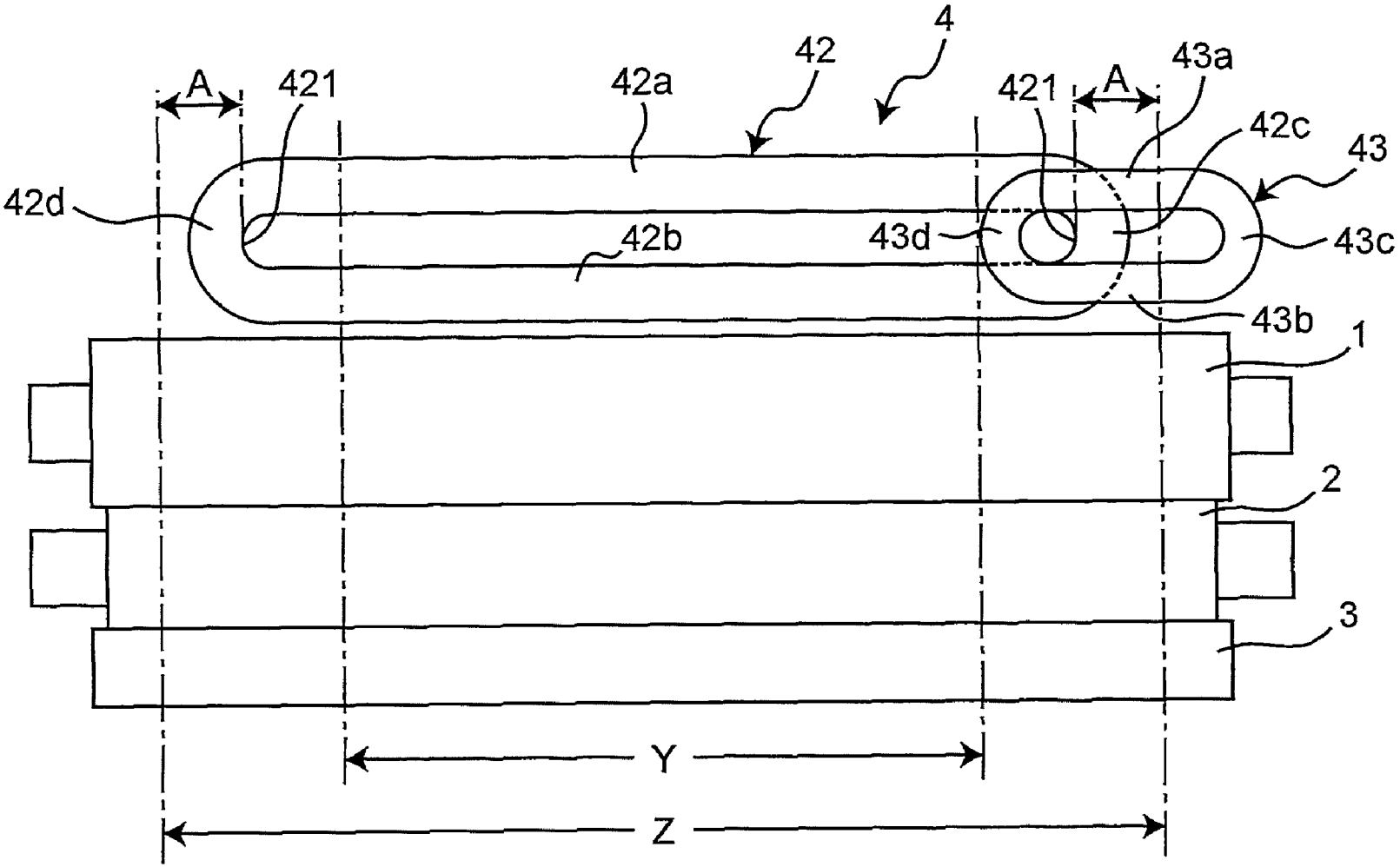
FIG. 7 is a development view showing a fixing device in another embodiment of the invention.

FIG. 7 shows a fixing device in a second embodiment of the invention. The second embodiment is different from the first embodiment in the point that the electromagnetic induction heating section 4 has degaussing coils 43 (one is omitted in FIG. 7). It is to be noted that component parts designated by the reference numerals identical to those in the first embodiment are identical in structure to those in the first embodiment, and therefore the description thereof is omitted.

As shown in FIG. 7, degaussing coils 43 of the electromagnetic induction heating section 4 (one is omitted in FIG. 7) cancel the magnetic flux generated by the exciting coil 42. Each of the degaussing coils 43, which is formed into a ring-like oval shape in plan view, extends in the width direction of the fixing roller 1. The degaussing coils 43 are placed so as to be superimposed on both the end sections 42*c* and 42*d* of the exciting coil 42.

The degaussing coil 43 is connected to a high-frequency inverter 7 (shown in FIG. 2). Passing of current is changed between the exciting coil 42 and the degaussing coil 43 with a change switch of the high-frequency inverter 7.

As with the exciting coil 42, the degaussing coil 43 has a pair of central sections 43*a*, 43*b* which extend in the width direction of the fixing roller 1, and a pair of end sections 43*c*, 43*d* positioned on both the ends in the width direction of the fixing roller 1 for coupling a pair of the central sections 43*a*, 43*b*.

A pair of the central sections 43*a*, 43*b* are in a generally linear shape which is generally parallel to the axis of the fixing roller 1. A pair of the end sections 43*c*, 43*d* are in a generally circular shape. A clearance exists between a pair of the central sections 43*a* and 43*b*.

The degaussing coil 43 extends to farther outside of the exciting coil 42 in the width direction of the fixing roller 1. In short, the degaussing coil 43 extends to farther outside of the edge of the maximum paper feed area Z in the width direction of the fixing roller 1. The degaussing coil 43 is positioned outside of a paper feed area Y of A4 portrait size paper in the width direction of the fixing roller 1.

Therefore, since the degaussing coils 43 are placed so as to lie on both the end sections 42*c*, 42*d* of the exciting coil 42, it becomes possible to reliably suppress heating of the non-paper feed area on the fixing roller 1. Since the degaussing coils 43 extend to farther outside of the exciting coil 42 in the width direction, it becomes possible to more reliably suppress heating of the non-paper feed area on the fixing roller 1.

Third Embodiment

Figure 8:
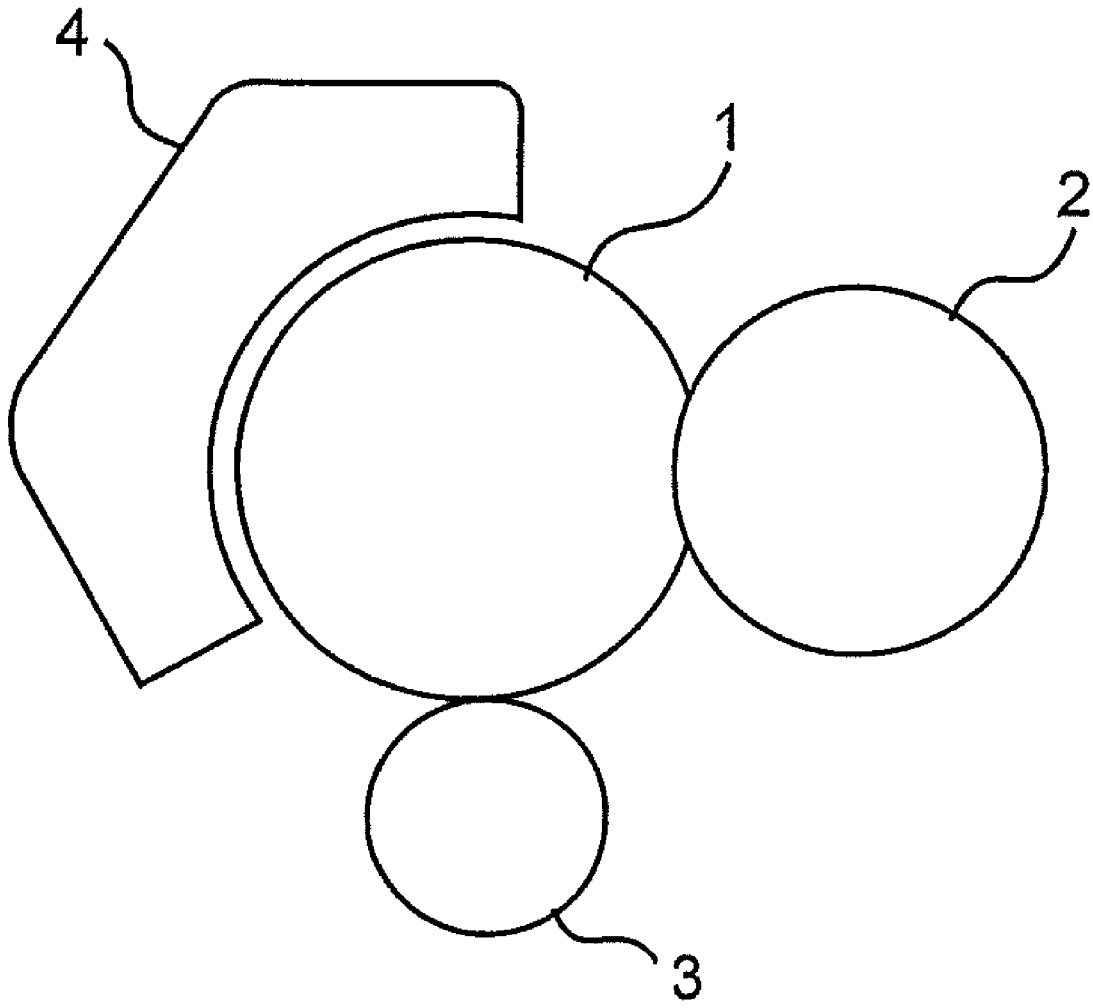
FIG. 8 is a simplified structure view showing a fixing device in still another embodiment of the invention.

FIG. 8 shows a fixing device in a third embodiment of the invention. The third embodiment is different from the first embodiment in the placement of the heat pipe 3. It is to be noted that component parts designated by the reference numerals identical to those in the first embodiment are identical in structure to those in the first embodiment, and therefore the description thereof is omitted.

As shown in FIG. 8, the heat pipe 3 comes into contact with the fixing roller 1. Therefore, the temperature in the width direction of the fixing roller 1 can be further equalized. Since the fixing roller 1 has a metal electromagnetic induction exothermic layer 13 (see FIG. 3), the heat in the fixing roller 1 can be transported via the electromagnetic induction exothermic layer 13 of the fixing roller 1, so that the temperature in the width direction of the fixing roller 1 can be equalized.

Figure 9A:
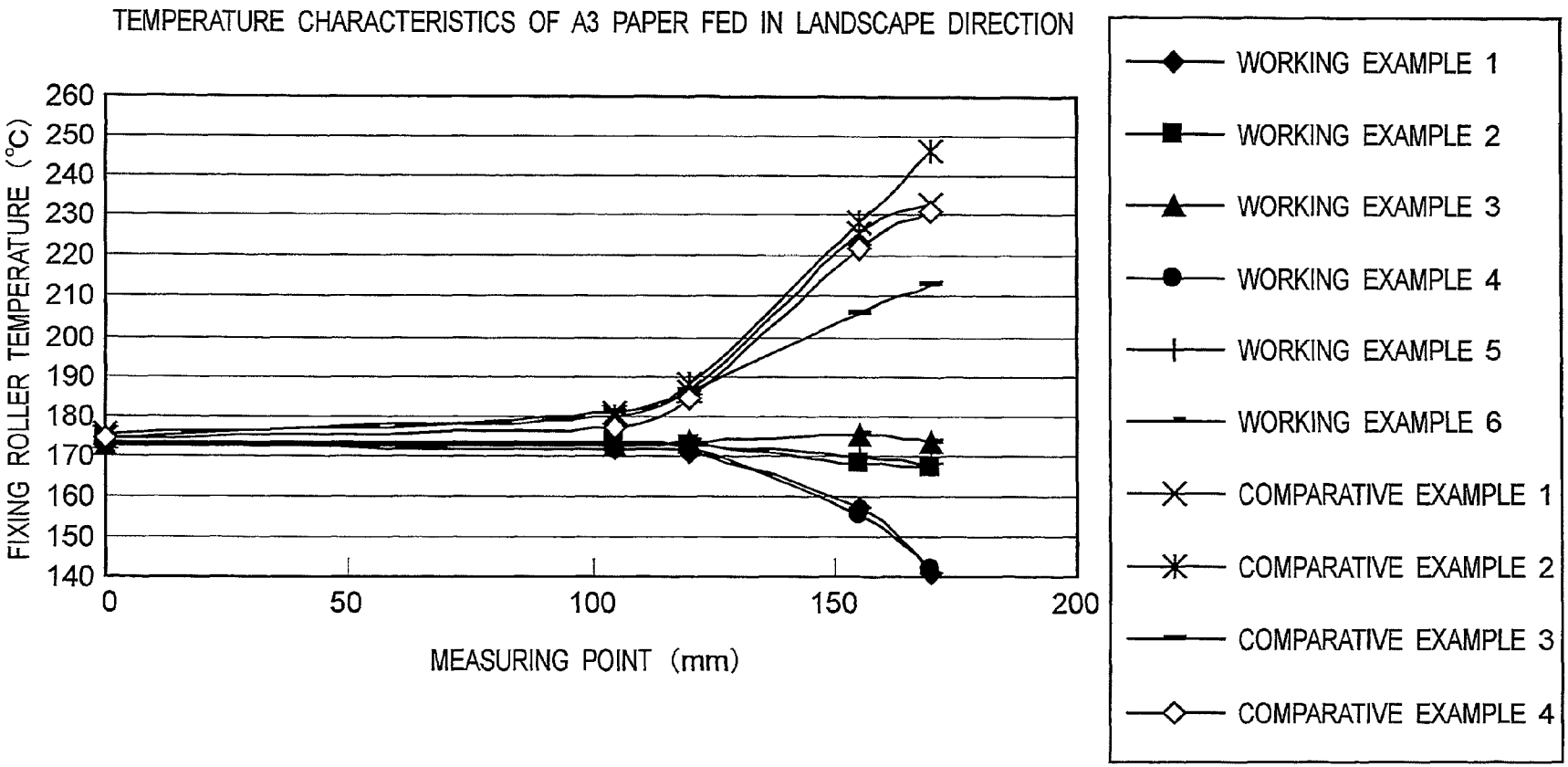
FIG. 9A is a graph view showing temperature characteristics for A3 paper fed in landscape direction.
Figure 9B:
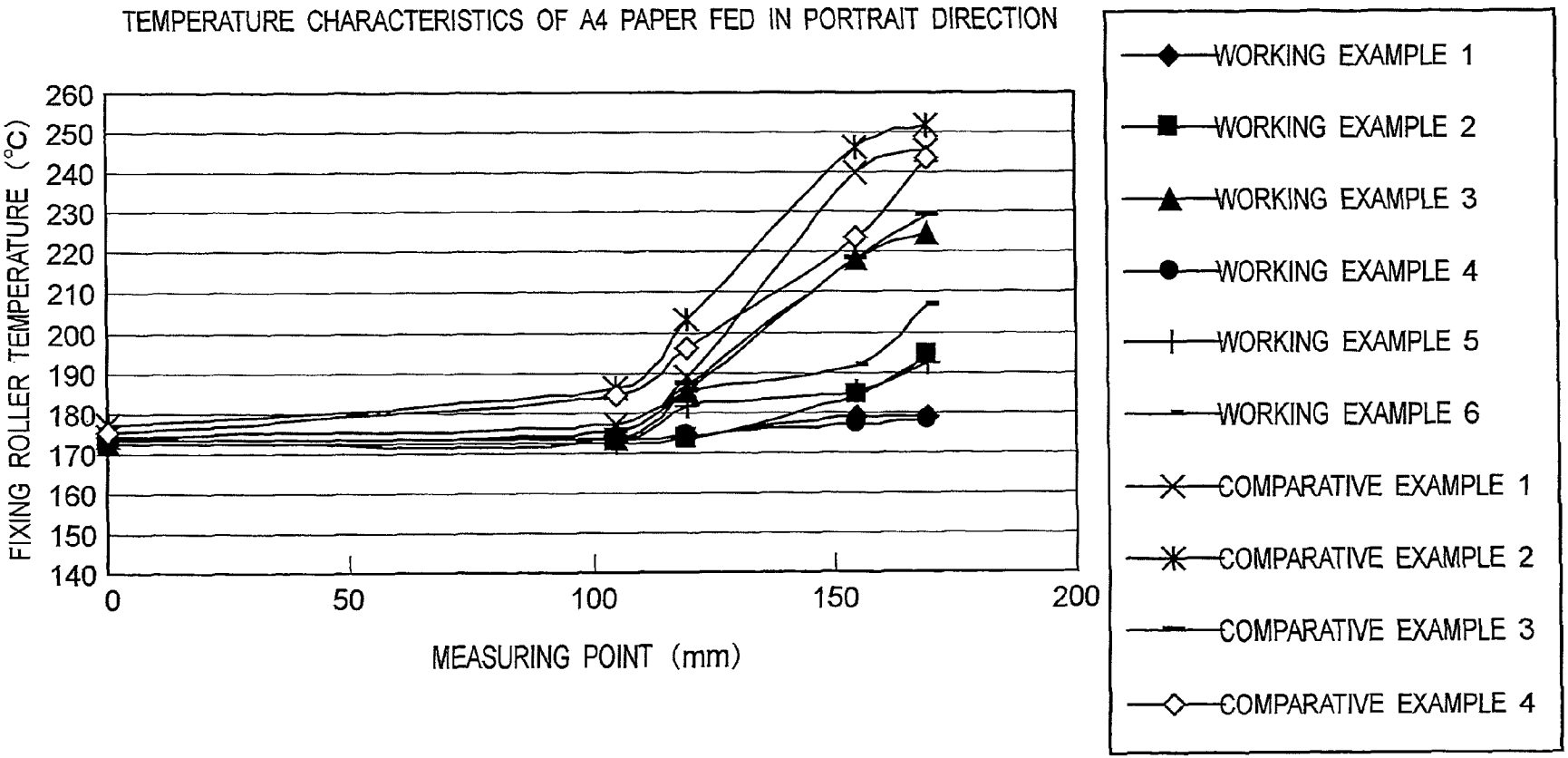
FIG. 9B is a graph view showing temperature characteristics for A4 paper fed in portrait direction.

FIG. 9A and FIG. 9B show the result of measurement of the position of the fixing roller in the width direction and the temperature of the fixing roller in the fixing device (working examples 1 to 6) of the invention and in comparative examples (comparative examples 1 to 4).

FIG. 9A shows the temperature characteristics of A3 paper fed in landscape direction, and FIG. 9B shows the temperature characteristics of A4 paper fed in portrait direction. The vertical axis represents the temperature of the fixing roller while the horizontal axis represents the measuring point when the center position in the width direction of the fixing roller is set to 0. Paper sheets were continuously fed under the paper feed conditions in which paper sheet grammage was 80 g/m$^2$, temperature was 23° C., relative humidity was 65%, and the image density of printed characters was 20%. The degaussing coils do not operate in the case of A3 paper fed in landscape direction, whereas the degaussing coils operate in the case of A4 paper fed in portrait direction.

FIG. 9A shows the plotted result of measurement of FIG. 10A, while FIG. 9B shows the plotted result of measurement of FIG. 10B.

In the working examples 1 to 3, the fixing device of the first embodiment (FIG. 6) is used, and when an area within the edge of the maximum paper feed area Z in the width direction of the fixing roller 1 is set as a negative area and an area outside the edge of the maximum paper feed area Z in the width direction of the fixing roller 1 is set as a positive area, the distance A is −15 mm in the working example 1, −10 mm in the working example 2, and 0 mm in the working example 3. As a comparison, the distance A is +10 mm in the comparative example 1, and +15 mm in the comparative example 2.

In the working examples 4 to 6, the fixing device of the second embodiment (FIG. 7) is used, and when an area within the edge of the maximum paper feed area Z in the width direction of the fixing roller 1 is set as a negative area and an area outside the edge of the maximum paper feed area Z in the width direction of the fixing roller 1 is set as a positive area, the distance A is −15 mm in the working example 4, −10 mm in the working example 5, and 0 mm in the working example 6. As a comparison, the distance A is +10 mm in the comparative example 3, and +15 mm in the comparative example 4.

As is clear from FIG. 9A and FIG. 9B, the rise of the temperature in the end section (non-paper feed area) in the width direction of the fixing roller can be suppressed in the working examples 1 to 6 (i.e., $A \leqq 0$). Contrary to this, the temperature rise in the non-paper feed area cannot be suppressed in the comparative examples 1 to 4 (i.e., $A>0$).

More specifically, as shown in FIG. 9A, at the measuring point of 170 mm, the temperature is 140.5° C. in the working example 1, 167.5° C. in the working example 2, 173.6° C. in the working example 3, 141.5° C. in the working example 4, 168.3° C. in the working example 5 and 173.5° C. in the working example 6, whereas the temperature is 232.7° C. in the comparative example 1, 246.6° C. in the comparative example 2, 212.9° C. in the comparative example 3, and 231.5° C. in the comparative example 4.

As shown in FIG. 9B, at the measuring point of 170 mm, the temperature is 179.1° C. in the working example 1, 193.8° C. in the working example 2, 224.6° C. in the working example 3, 177.7° C. in the working example 4, 192.1° C. in the working example 5 and 206.6° C. in the working example 6, whereas the temperature is 245.5° C. in the comparative example 1, 251.8° C. in the comparative example 2, 229.3° C. in the comparative example 3, and 243.5° C. in the comparative example 4.

The present invention shall not be limited to the above-disclosed embodiments. For example, the fixing-side rotating member and the pressure-side rotating member may be formed into a belt shape instead of the roller shape. Moreover, a soaking member may be provided so as to come into contact with both the fixing-side rotating member and the pressure-side rotating member.

The soaking member may be constituted of a metal cylindrical member instead of the heat pipe 3, with the thermal conductivity of the cylindrical member being, for example, 14.0 W/m° C. or more.

The pressure-side rotating member (pressure roller 2) has only to have a cored bar and at least a metal layer outside of the cored bar in the radial direction. The fixing-side rotating member (fixing roller 1) has only to have a cored bar and at least a metal electromagnetic induction exothermic layer outside of the cored bar in the radial direction.

Without being limited to the oval shape in plan view, the exciting coil 42 and the degaussing coil 43 may take other shapes such as elliptical shape and rectangular shape.

Embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A fixing device comprising:

a fixing-side rotating member and a pressure-side rotating member which come into contact with each other to convey a recording material while fixing toner on the recording material;

an electromagnetic induction heating section for performing induction heating of the fixing-side rotating member; and a soaking member which comes into contact with at least one of the fixing-side rotating member and the pressure-side rotating member, wherein the electromagnetic induction heating section has an annular exciting coil extending in a width direction of the fixing-side rotating member, the exciting coil has both end sections in the width direction of the fixing-side rotating member, a portion on each inner surface of both the end sections, which is positioned on an outermost side in the width direction, is identical with an edge of a passing area of a maximum-size recording material which passes through between the fixing-side rotating member and the pressure-side rotating member, or is positioned within the edge of the passing area in the width direction, and the soaking member extends to farther outside of the passing area of the maximum-size recording material in the width direction.

2. The fixing device according to claim 1, wherein the electromagnetic induction heating section has degaussing coils which cancel magnetic flux generated by the exciting coil, and the degaussing coils are placed so as to be superimposed on both the end sections of the exciting coil.

3. The fixing device according to claim 2, wherein the degaussing coils extend farther outside of the exciting coil in the width direction.

4. The fixing device according to claim 1, wherein the soaking member comes into contact with the pressure-side rotating member, the soaking member is a heat pipe, and the pressure-side rotating member has a cored bar and at least a metal layer outside of the cored bar in a radial direction.

5. The fixing device according to claim 1, wherein the soaking member comes into contact with the fixing-side rotating member, the soaking member is a heat pipe, and the fixing-side rotating member has a cored bar and at least a metal electromagnetic induction exothermic layer outside of the cored bar in a radial direction.

6. An image forming apparatus comprising the fixing device in claim 1.

* * * * *